US006320111B1

(12) United States Patent
Kizaki

(10) Patent No.: US 6,320,111 B1
(45) Date of Patent: Nov. 20, 2001

(54) MUSICAL PLAYBACK APPARATUS AND METHOD WHICH STORES MUSIC AND PERFORMANCE PROPERTY DATA AND UTILIZES THE DATA TO GENERATE TONES WITH TIMED PITCHES AND DEFINED PROPERTIES

(75) Inventor: Takahiro Kizaki, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/605,510

(22) Filed: Jun. 28, 2000

(30) Foreign Application Priority Data

Jun. 30, 1999 (JP) ..... 11-185470

(51) Int. Cl.[7] ..... G10H 1/26
(52) U.S. Cl. ..... 84/609
(58) Field of Search ..... 84/609–614, 634–638

(56) References Cited

U.S. PATENT DOCUMENTS 5,347,082 9/1994 Ojima ..... 84/609
5,918,303 * 6/1999 Yamaura et al. ..... 84/609

FOREIGN PATENT DOCUMENTS 7-52342 6/1995 (JP) .

* cited by examiner

*Primary Examiner*—Stanley J. Witkowski
(74) *Attorney, Agent, or Firm*—Rossi & Associates

(57) ABSTRACT

An electronic musical apparatus stores, in a storage device, plural song data sets, each data set having a song ID and representing tone events in a time progression to constitute a piece of music, and plural performance property data sets, each data set having a property ID and representing tone properties for the musical tones when played back. The song ID's and the property ID's are selectively nominated with correspondence therebetween one after another, and are stored in the storage device to constitute a song chain list representing chained music pieces. In a song chain playback mode, the song chain list is read out to get the song ID's and the property ID's. The song data and the property data are read out according to thus read-out song ID's and property ID's. A tone generator generates musical tones according to the song data and the property data. In a song playback mode, an individual song data set is designated and read out, and such a read-out song data set controls the tone generator to play back the designated music piece.

11 Claims, 7 Drawing Sheets

Fig. 2d

Song Chain Data

| | |
|---|---|
| Property No.(1) | Song No.(1) |
| Property No.(2) | Song No.(3) |
| Property No.(1) | Song No.(5) |
| | |
| | |
| End Data | |

Fig. 2c

Assignment Table

| | |
|---|---|
| CH1 | Song Data Track No. (1) |
| CH2 | Song Data Track No. (1) |
| CH3 | Song Data Track No. (2) |
| | |

*Fig. 3a* Main Routine (1)
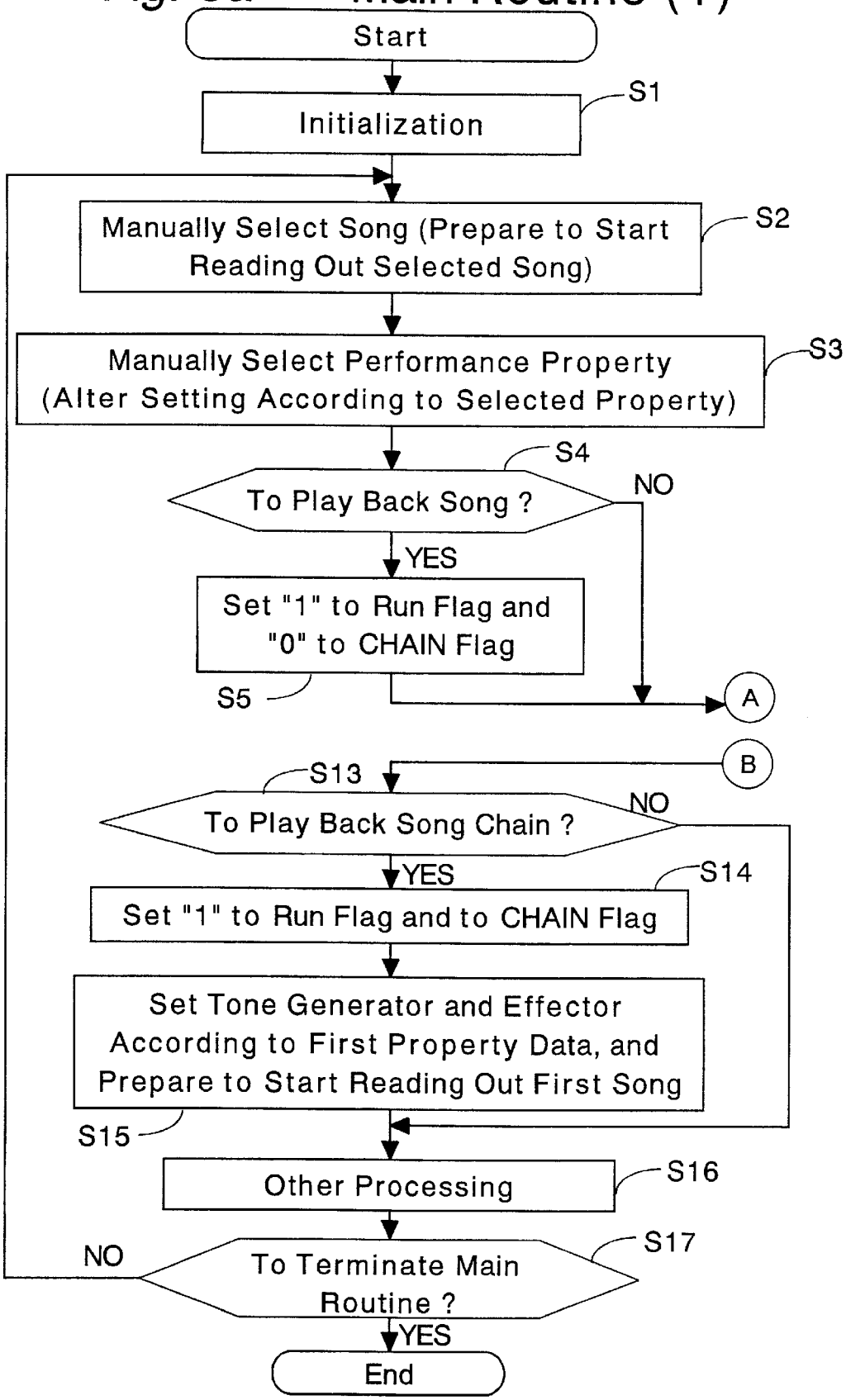

*Fig. 3b* Main Routine (2)
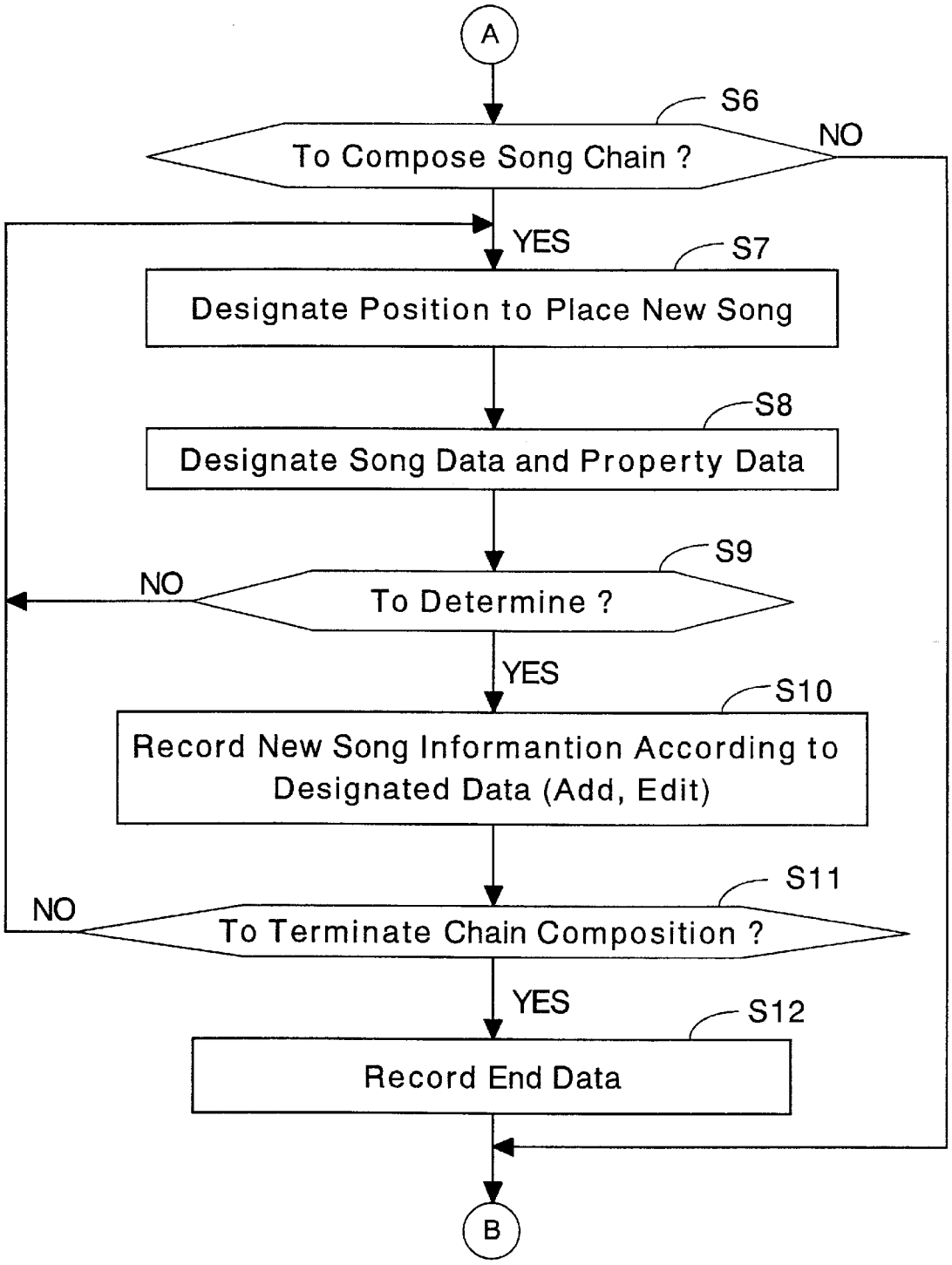

*Fig. 4a* Interrupt Processing (1)
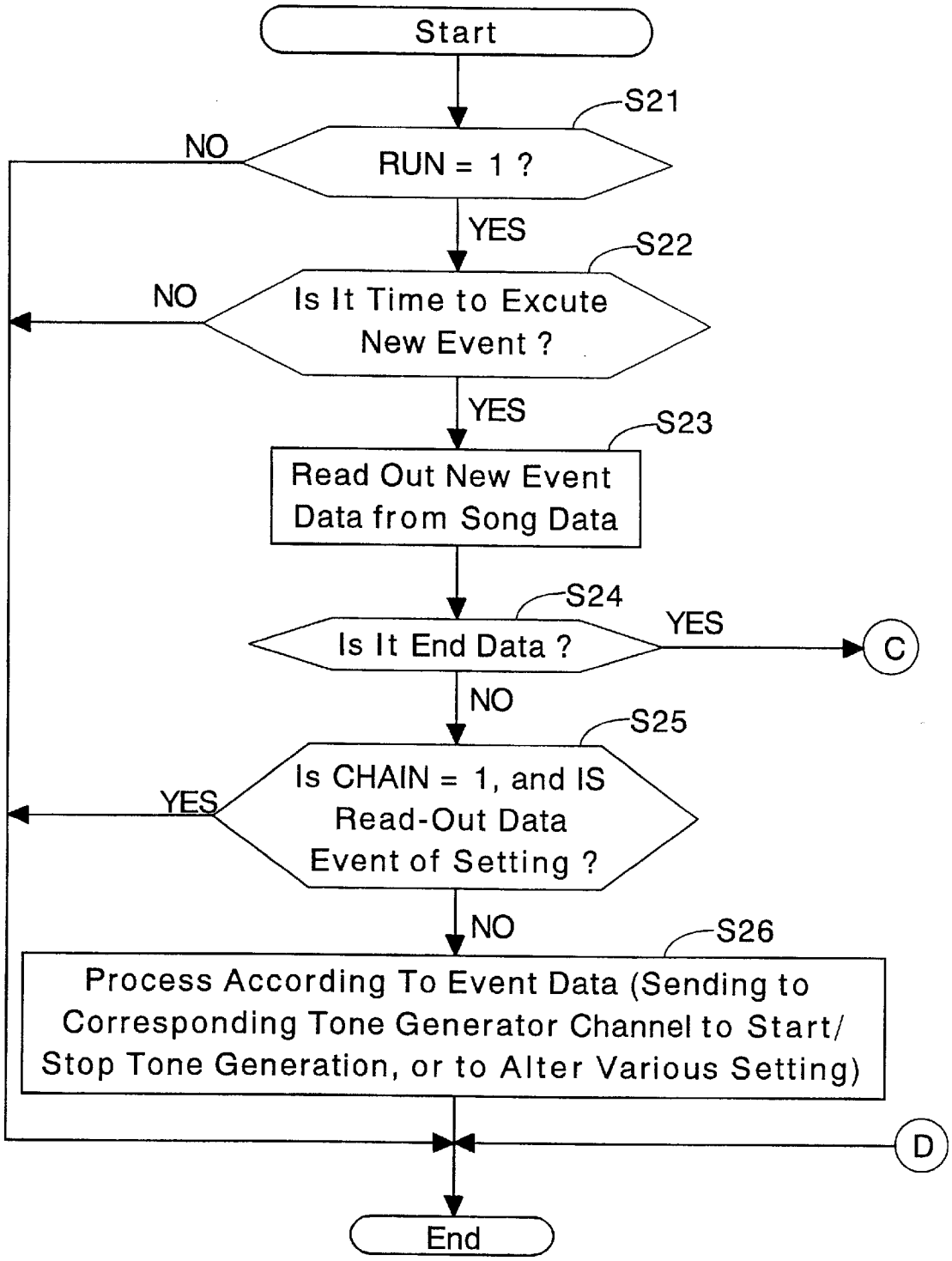

*Fig. 4b* Interrupt Processing (2)
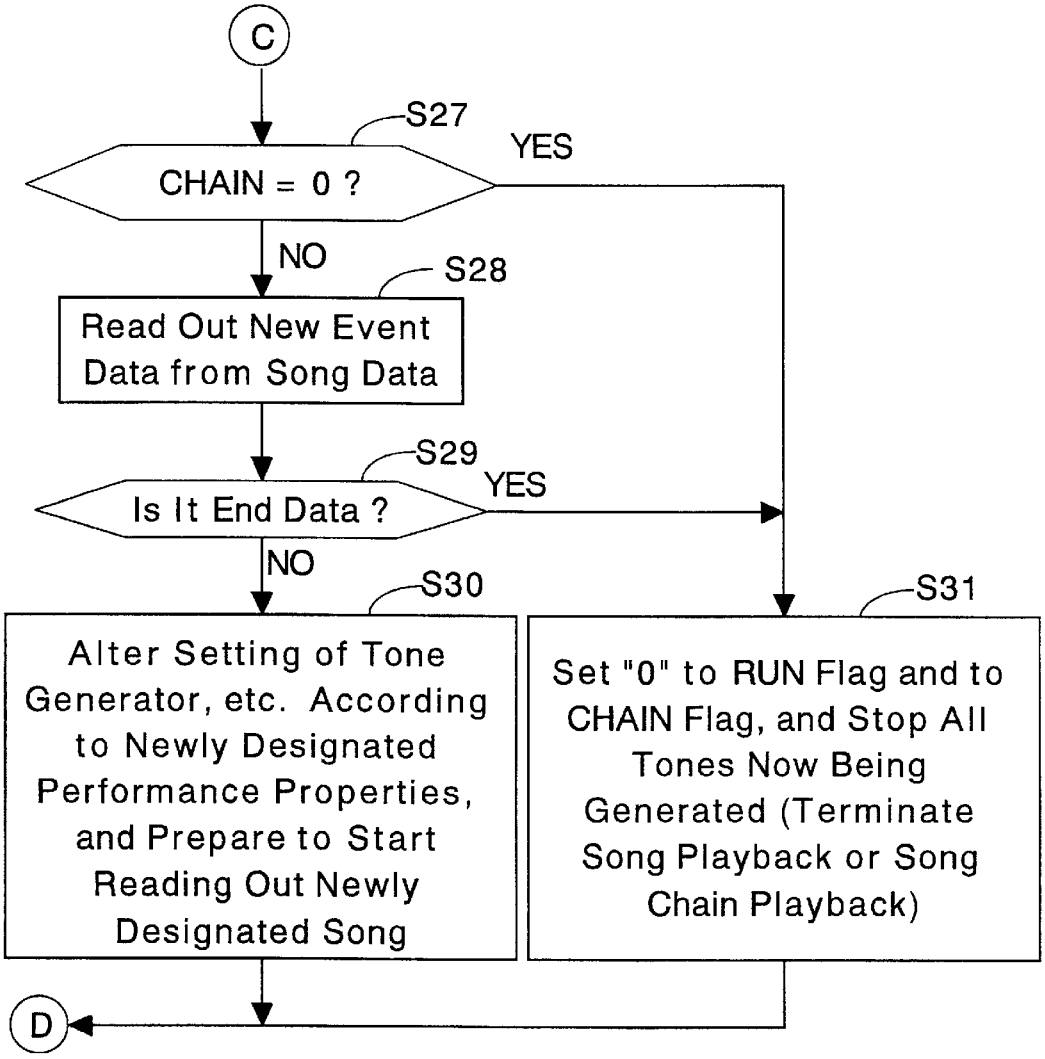

MUSICAL PLAYBACK APPARATUS AND METHOD WHICH STORES MUSIC AND PERFORMANCE PROPERTY DATA AND UTILIZES THE DATA TO GENERATE TONES WITH TIMED PITCHES AND DEFINED PROPERTIES

RELATED APPLICATION

This application claims priority from Japanese Patent Application No. 11-185470, filed Jun. 30, 1999, the contents of which are incorporated hereinto by this reference.

BACKGROUND OF THE INVENTION

1. Field of the Invention

The present invention relates generally to an apparatus and a method for playing back music pieces from music data and for composing a playback list therefor, and more particularly to an apparatus and a method for playing back a chain of songs automatically and an apparatus and a method for composing a data set of a song chain list for such an automatic playback. The term "song" in this context means a piece of music comprised of a time progression of tones, whether vocal or instrumental, whether with words or without words, as long as not otherwise defined specifically in the description. The present invention also relates to a computer readable medium containing a computer program to configure and operate the above apparatuses and methods using a computer and the associated circuits and devices.

2. Description of the Prior Art

There have conventionally been known in the art some types of electronic musical apparatuses such as electronic musical instruments which are incorporated with a function called "song chain function" with which a plurality of songs (i.e. music pieces) can be played back automatically according to the designated order of the songs stored in the form of musical data representing a progression of tones. Further, in the conventionally known art, there are automatic song playback apparatuses in which the stored song data are delivered to a tone generator device having a plurality of tone generation channels assigned to respective performance parts (e.g. a piano part, a string part, a wood wind part, a brass part, etc.) to play back a song and in which the properties of the generated tones are selectively determined by collectively setting performance property data including tone color parameters, tone effect parameters, etc. for each tone generation channel, thereby enabling a variety of performance arrangements in the played-back song. With such a musical apparatus, in order to alter the setting of the performance property data synchronously with the change of the songs from one to another during the song chain playback operation, the user should select intended performance properties manually at the very time of the change of the songs or such performance property parameters for the tone generator channels should be previously inserted in the respective song data to be played back.

However, in the conventional apparatus having a song chain playback function, the previously prepared songs can be played back only in the designated order, and a variety of sequences of the chained playback can not be obtained at a one-time setting. In order to increase the number of songs (music pieces) to play back, the increased number of songs should be stored in the apparatus, but this approach is disadvantageous in that the free space in the storage device will be suppressed accordingly.

On the other hand, the use of performance property data with the song data may modify the musical arrangement in the played-back performance to increase the variety, but the manual changes of the performance property data at the time of the change of the songs would be a burdensome hard job for the user. Further, the operation for previously inserting the setting parameters into the song data means to insert the data respectively necessary for introducing musical arrangements at the intended points in the song data using a conventional song data editing apparatus, and such an operation will be a hard and troublesome job especially for the beginners.

SUMMARY OF THE INVENTION

It is, therefore, a primary object of the present invention to solve the above-mentioned drawbacks involved in such conventional apparatuses or methods for playing back a chain of songs, and to provide an improved song chain playback apparatus and method and an improved song chain list composing apparatus and method which are capable of sequentially playing back songs including a variety of modifications in the musical arrangements and of composing a data set of a song chain list, in a simplified operation for the user.

In order to accomplish the object of the present invention, the invention provides a song chain playing-back apparatus comprising: a first data storage area which stores a plurality of song data sets, each having a song identification number and representing a song as a time progression of musical tones defined by pitches and times; a second data storage area which stores a plurality of performance property data sets, each having a property identification number and representing a set of performance properties defining tone properties such as tone colors and tone effects of the musical tones when performed; a third data storage area which stores a chain list data set containing a list of the song identification numbers indicative of song data sets to be played back from among the plurality of song data sets in the order for playback and a list of the property identification numbers indicative of performance property data sets to be employed from among the plurality of performance property data sets in the order for employment; a chain list reading module which reads out the song identification numbers in the order for playback and the property identification numbers in the order for employment; a song data reading module which reads out the song data sets as identified by the read-out song identification numbers; a property data reading module which reads out the performance property data sets as identified by the read-out property identification numbers; and a tone generating module which generates tones with tone pitches and at times defined by the read-out song data set and in tone properties defined by the read-out performance property data set.

According to the above mentioned structure of a song chain playing-back apparatus, a song chain list represents plural songs to be played back in the designated order and plural performance property sets to define tone colors, tone effects, etc. to be employed for the playback of the songs in the designated order, and the songs are automatically played back in a chain according to the order designated by the song chain list, while the tone properties for the respective songs are also determined automatically according to the order designated by the song chain list, namely in the corresponding relationship between the songs and the tone properties according to the designated orders. Therefore, a plurality of songs can be automatically played back with varieties of tone properties from one song to another, i.e. with different arrangements from one song to another.

In another aspect of the present invention, a song chain playing-back apparatus further comprises: an individual song designating module which is selectively operative and is capable of designating individual song data set from among the plurality of song data sets; and wherein the song data set includes data regarding tone pitches and times for the musical tones in the song and further includes data regarding tone properties for the musical tones in the song; and when the individual song designating module is selected operative, the song data reading module reads out, according to the individual designation, the song data set including data regarding tone pitches, times and tone properties, and the tone generating module generates tones with tone pitches, at times and in tone properties as defined by the individually designated song data set; and when the individual song designating module is selected non-operative, the song data reading module reads out the song data set including data regarding tone pitches and times but disregarding tone properties, and the tone generating module generates tones with tone pitches and at times defined by the read-out song data set and in tone properties defined by the read-out performance property data set. Accordingly, the chained songs or the individual songs can be played back selectively, and differently with tone properties.

In order to accomplish the object of the present invention, the invention further provides a song chain data composing apparatus comprising: a first data storage area which stores a plurality of song data sets, each having a song identification number and representing a song as a time progression of musical tones defined by pitches and times; a second data storage area which stores a plurality of performance property data sets, each having a property identification number and representing a set of performance properties defining tone properties of said musical tones when performed; a third data storage area for storing a chain list data set containing a list of the music identification numbers indicative of song data sets to be played back from among the plurality of song data sets in the order for playback and a list of the property identification numbers indicative of performance property data sets to be employed from among the plurality of performance property data sets in the order for employment; a chain list nominating module which nominates the song identification numbers, one after another in a desired order for playback and the property identification numbers, one after another in a desired order for employment; and a chain list data storing module which stores the nominated music identification numbers and the nominated property identification numbers into the third data storage area, thereby composing a data set representing a list of chained songs.

According to the above mentioned structure of a song chain data composing apparatus, a song chain list can be easily composed for automatically designating the songs to be played back in the prescribed order and also designating the performance properties to be employed for the designated song. Thus, a song chain list for automatically playing back the songs with adequate tone properties and in different arrangements can be easily composed.

As will be understood from the above description about a song chain playing-back apparatus and a song chain data composing apparatus, a sequence of steps each performing the operational function of each of the structural element devices and modules of the song chain playing-back apparatus and the song chain data composing apparatus will constitute inventive methods for playing back a song chain and composing a song chain list according to the spirit of the present invention.

The present invention still further provides a storage medium for use in an apparatus for playing back chained songs, the apparatus being of a data processing type comprising a computer and a storage device, the medium containing a program that is executable by the computer, the program comprising: a module of storing in the storage device a plurality of song data sets, each having a song identification number and representing a song as a time progression of musical tones defined by pitches and times; a module of storing in the storage device a plurality of performance property data sets, each having a property identification number and representing a set of performance properties defining tone properties of the musical tones when performed; a module of storing in the storage device a chain list data set containing a list of the song identification numbers indicative of song data sets to be played back from among the plurality of song data sets in the order for playback and a list of the property identification numbers indicative of performance property data sets to be employed from among the plurality of performance property data sets in the order for employment; a module of reading out the song identification numbers in the order for playback and the property identification numbers in the order for employment; a module of reading out the song data sets as identified by the read-out song identification numbers; a module of reading out the performance property data sets as identified by the read-out property identification numbers; and a module of generating tones with tone pitches and at times defined by the read-out song data set and in tone properties defined by the read-out performance property data set.

The present invention still further provides a storage medium for use in an apparatus for composing a data set representing a list of chained songs, the apparatus being of a data processing type comprising a computer and a storage device, the medium containing a program that is executable by the computer, the program comprising: a module of storing in the storage device a plurality of song data sets, each having a song identification number and representing a song as a time progression of musical tones defined by pitches and times; a module of storing in the storage device a plurality of performance property data sets, each having a property identification number and representing a set of performance properties defining tone properties of the musical tones when performed; a module of nominating the song identification numbers indicative of song data sets to be played back from among the plurality of song data sets, one after another in a desired order for playback and the property identification numbers indicative of performance property data sets to be employed from among the plurality of performance property data sets, one after another in a desired order for employment; and a module of storing in the storage device the nominated song identification numbers and the nominated property identification numbers to constitute a list of the song identification numbers and a list of the property identification numbers, thereby composing a data set representing a list of chained songs.

According to the above-mentioned computer programs, a song chain playing-back apparatus and a song chain list composing apparatus can be easily configured by installing the program into an apparatus of a data processing type and with a computer and a storage device so that a plurality of songs will be automatically played back in a chain according to the order designated by the song chain list, while the tone properties for the respective songs are also determined automatically according to the order designated by the song chain list, namely in the corresponding relationship between the songs and the tone properties according to the designated orders and so that a song chain list can be easily composed for automatically designating the songs to be played back in the prescribed order and also designating the performance properties to be employed for the designated song. Therefore, a plurality of songs can be automatically played back with varieties of tone properties from one song to another, i.e. with different arrangements from one song to another. And also, a song chain list representing a chained playback of songs in a desired order of the songs and with a variety of performance properties can be easily composed.

Further as will be apparent from the description herein later, some of the structural element devices (modules) of the present invention are configured by computer sub-systems performing the assigned functions according to the associated programs. They may of course be hardware structured discrete devices performing the same functions.

The present invention may take form in various components and arrangement of components including hardware and software, and in various steps and arrangement of steps. The drawings are only for purposes of illustrating a preferred embodiment and processes, and are not to be construed as limiting the invention.

BRIEF DESCRIPTION OF THE DRAWINGS

For a better understanding of the present invention, and to show how the same may be practiced and will work, reference will now be made, by way of example, to the accompanying drawings, in which:

FIG. 2*c* is a conceptual chart of an example of an assignment table employed in an embodiment of the present invention;

FIG. 2*d* is a conceptual chart of an example of a song data set employed in an embodiment of the present invention;

FIGS. 3*a* and 3*b*, in combination, are a flow chart showing a main routine of the control program executed in an embodiment of the present invention; and FIGS. 4*a* and 4*b*, in combination, are a flow chart showing an interrupt processing executed in an embodiment of the present invention.

DESCRIPTION OF THE PREFERRED EMBODIMENTS

Figure 1:
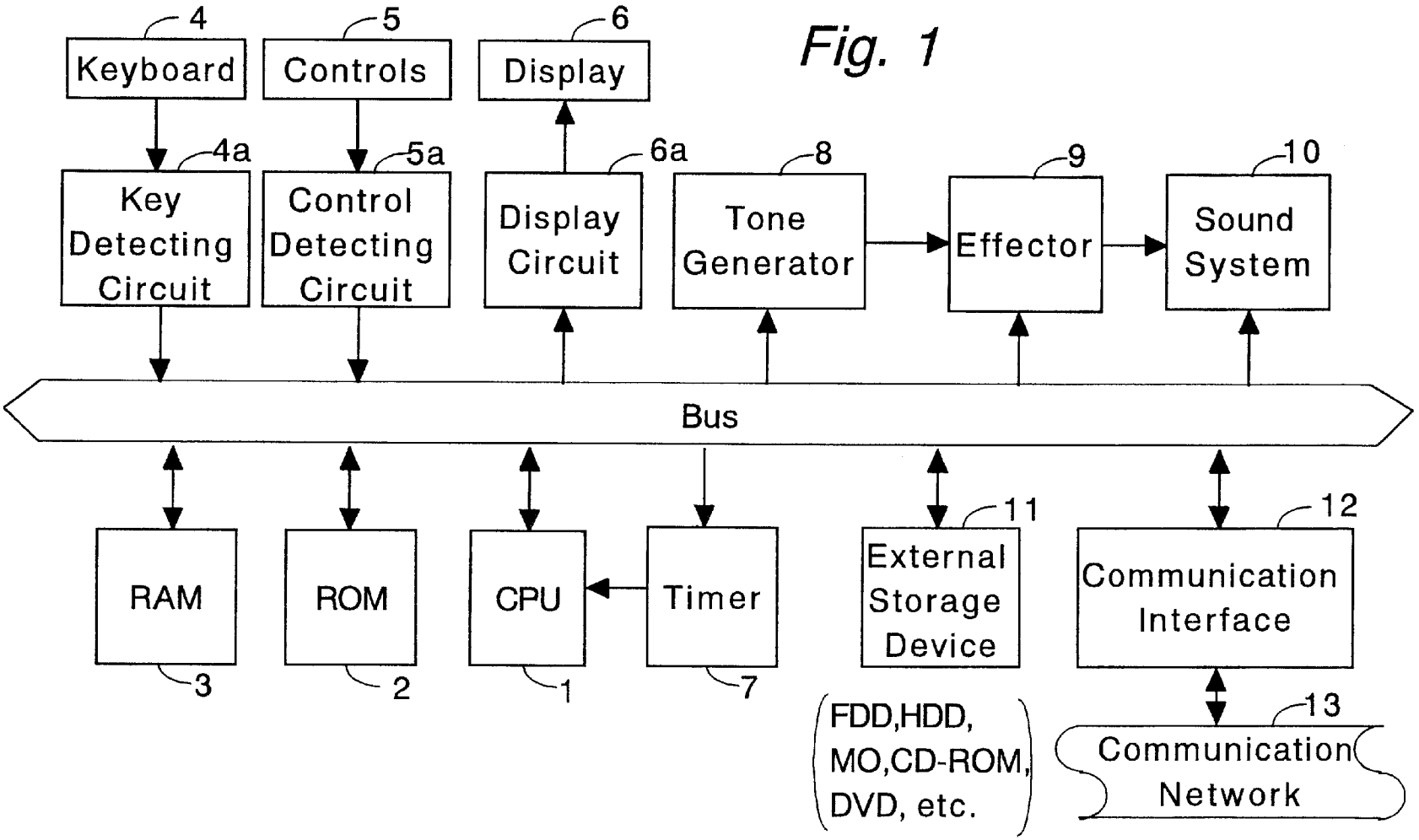
FIG. 1 is a block diagram showing a circuit structure of an example of a keyboard electronic musical instrument constituting an apparatus for playing back a song chain and composing song chain data according to the present invention.

FIG. 1 shows a block diagram of a circuit structure of an example of a keyboard electronic musical instrument operating as an apparatus for playing back a chain of songs and composing a data set of a song chain list. In FIG. 1, a CPU 1 controls overall operations of the electronic musical instrument according to control programs stored in a ROM 2 and using working areas in a RAM 3. As a basic function of a typical electronic musical instrument, the CPU 1 detects key events (events of manipulation of keys) in a keyboard 5 by means of a key detecting circuit 4*a* to control tone generations for a music performance, and detects control events (events of manipulation of controls) among various controls (switches, etc.) 5 by means of a control detecting circuit 5*a* to conduct the respective processes in response to the actuation of the respective controls and switches as mentioned hereinafter. The CPU 1 further controls a display device 6 such as a liquid crystal display panel via a display circuit. 6*a*.

In the embodiment, a computer program for composing a song chain list and playing back songs in a chain contains program instructions for the song chain data composing processing and those for the interrupt processing in the form of a control program stored in the ROM 2. The song chain data composing processing is to compose a data set of a song chain list which includes a list of song identification numbers indicative of song data sets in the order for successive playback and a list of property identification numbers indicative of performance property data sets in the order for employment in connection with the respective song data sets, which will be described in more detail hereinafter. When the apparatus plays back the song data sets according to the designation by the song chain list, the performance property data sets which respectively correspond to the song data sets by the respective corresponding orders are employed in setting the parameters for the tone generation at a tone generator 8 and in setting the parameters for the effect impartation at an effector 9.

A timer 7 generates interruption timing signals for triggering interrupt operation for the processing of an automatic playback of the songs in a chain. When the user commands one song to be played back by a song data set individually, the apparatus plays back the commanded song individually (song playback) at a tempo determined by the tempo data included in the song data set, whereas when the user commands chained songs to be played back by referring to a song chain list successively, the apparatus plays back the songs in a chain as designated by the song chain list at a tempo determined by the tempo data included in the performance property data set, in which latter case the interrupt signals are given at a time interval according to the determined tempo. For example, the interrupt signals are generated at a rate of 96 counts per quarter note, and the CPU 1 counts the clock pulse at every interrupt time and tells the time for each event of note-on's and note-offs, or others.

The tone generator 8 operates in a time division multiplexed fashion, which constitutes a plurality of tone generation channels for generating a plurality of musical tones concurrently (substantially at a same time). The CPU 1 sets parameters for each of the tone generation channels to determine the tone color, the tone volume, etc. according to the performance property data, and each tone generation channel generates musical tones in the tone color, the tone volume, etc. as determined by those set parameters with the tone pitches and at times designated by the song data. The CPU 1 also sets parameters for the effector 9 to determine the tone effects to be imparted to the generated tones according to the performance property data, and thus effect-imparted musical tone signals are outputted to a sound system 10, which in turn conducts a D/A conversion, an amplification, etc. to finally emit audible sounds into the air via a loudspeaker. The parameter setting for the tone color and the tone volume in connection with the tone generator 8, and the parameter setting for the tone effects in connection with the effector 9 may be conducted by the manual controls 5 including tone color setting switches, tone volume setting switches, tone effect setting switches, and so forth as in a conventional electronic musical instrument.

An external storage device 11 may be a floppy disk drive (FDD), a hard disk drive (HDD), a CD-ROM drive, a magneto-optical disk drive (MO), a digital versatile disk drive (DVD), etc. The song data may be supplied from a disk medium in such an external storage device 11, and the performance property data or the composed song chain list data may be stored in such an external storage device 11 as well, as will be described later. A communication interface 12 is a MIDI interface or the like, and will serve to receive song data from another MIDI apparatus via a communication network 13, whereby the received song data may be stored in the external storage device 11 or the RAM 3.

The controls 5 and the display screen 6 are both arranged on the main panel of the electronic musical instrument. The controls 5 include a song chain composition switch for commanding a start of song chain data composition, a song playback switch for commanding a playback of an individual song, a song chain playback switch for commanding a successive playback of a plurality of chained songs under the song chain function, a performance property selection switch for selecting performance data, a song selection switch for selecting a song, a tone color setting switch for setting a tone color, an effect setting switch for setting a tone effect, a tempo setting switch for setting a tempo, etc.

The ROM 2 stores a plurality of song data sets and a plurality of performance property data sets which are previously prepared as preset data sets. The RAM 3 stores a plurality of song data sets and a plurality of performance property data sets which are created or edited by a user, a song chain list data set which is composed by a user, an assign table which stores the corresponding relation between the tone generation channels of the tone generator 8 and the track (performance part) of the song data sets, various flags for various operational controls, and so forth.

Figure 2B:
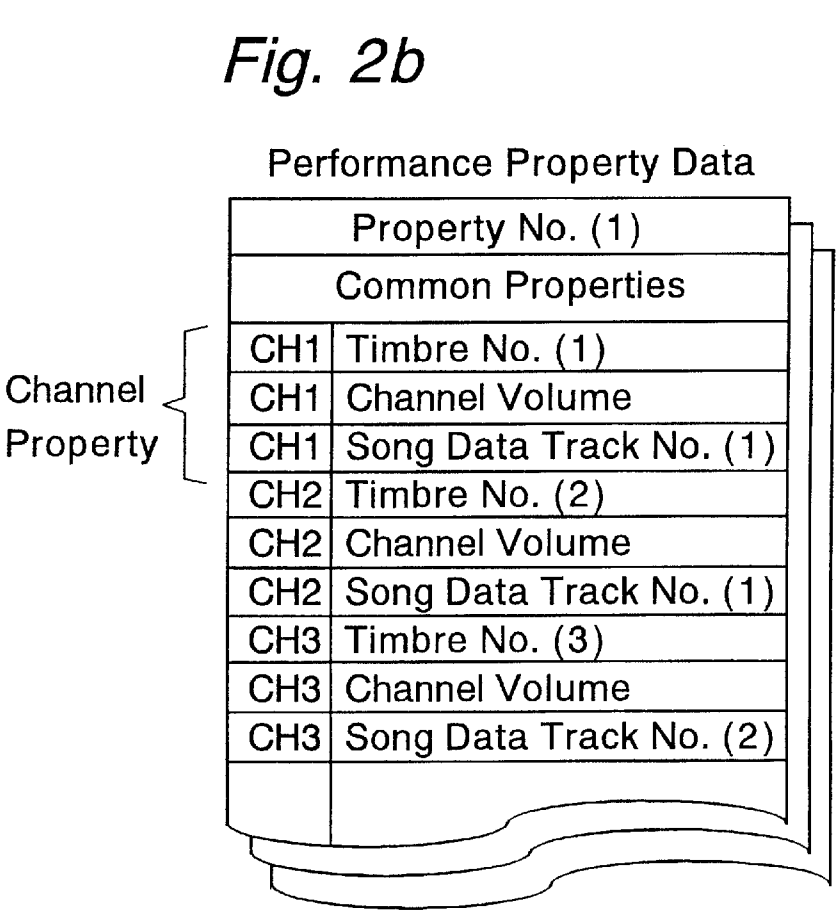
FIG. 2*b* is a data format chart of an example of performance property data sets employed in an embodiment of the present invention.
Figure 2A:
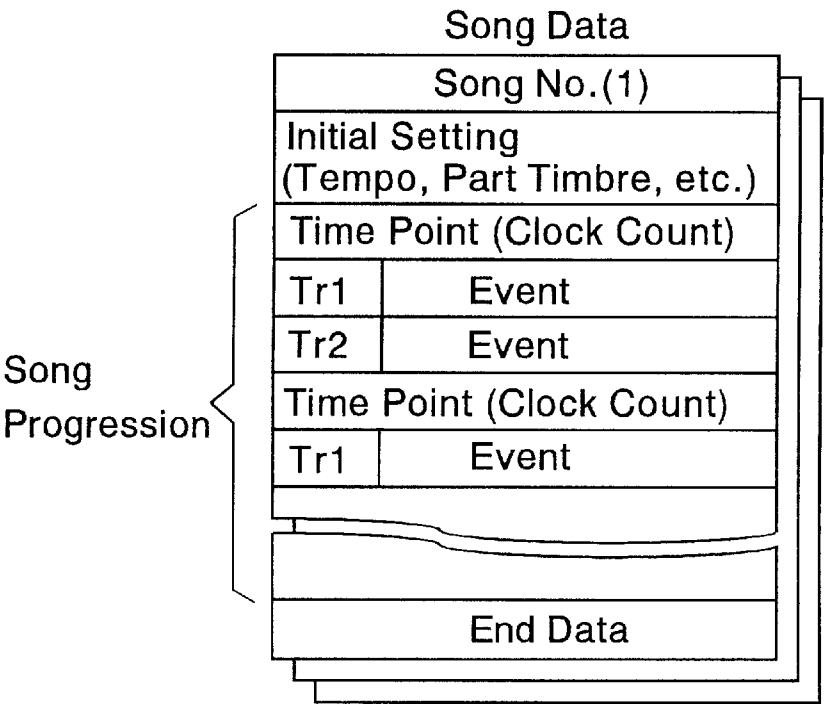
FIG. 2*a* is a data format chart of an example of song data sets employed in an embodiment of the present invention.

FIG. 2*a* shows a data format of an example of song data sets employed in an embodiment of the present invention. A song data set represents a song (i.e. a music piece) constituted by a progression of musical tones having tone pitches and generation times. Among three song data sets, one is illustrated in detail in FIG. 2*a*. Each song data set contains at its top a song ID number to identify the song from among others. Following the song ID number, the song data set further contains initial setting data, song progression data consisting of times and events, and finally end data representing the end of the song.

The initial setting data contains information for setting various parameters for a song playback, and more specifically, the parameters determining a tempo, an initial tone color for each performance part in the song playback, a tone color for a keyboard performance, tone effects to be imparted to the generated musical tones. But such initial setting data may not necessarily be contained in the stored song data set.

Among the song progression data portion, time point data indicates a time point at which an event or events indicated by the following event data will occur, (i.e. at which the event data should be read out) and is expressed by a clock count number from the top of the song. The event data to be read out concurrently at one time point are recorded in a group just after the intended time point. The event data include track numbers (e.g. Tr1, Tr2) for the respective events to represent the performance parts (tracks) of the events in the song data set. There are two categories of event data, event information for each of the tracks (as expressed with track numbers) and event information for overall tracks in common (as expressed without a track number). The former category includes key-on data, key-off data, pitch change data, tone volume change data, tone color change data, etc., while the latter category includes tempo change data, effect change data, etc. The song data may be previously stored in the ROM 2, or may be composed and edited by the user and stored in the RAM 3, or may be stored in the external storage device 11, and the above format may apply in any of the cases.

FIG. 2*b* shows a data format of an example of performance property data sets employed in an embodiment of the present invention. A performance property data set represents tone properties for the performance when played back. Among three performance property data sets, one is illustrated in detail in FIG. 2*b*. Each performance property data set contains at its top a performance property ID number to identify the property from among others. Following the performance property number, the performance property data set further contains common property data, and channel property data representing information for the respective tone generation channels of the tone generator 8.

The common property data contains tempo data, effect data representing various tone effects to be imparted to the generated tones, master volume data determining the general volume for the playback of a song, function assignment data defining the assignment of various functions to the respective controls or switches, and so forth.

The channel property data are parameter data for setting or determining tone properties of the musical tones generated by each of the tone generation channels and include, for each of the channels, a tone color ID number indicative of the kind of tone color assigned to the tone generation channel, a channel volume indicative of the relative tone volume for the tone generation channel, a song data track number indicative of the track number of the song data to be assigned to the tone generation channel, etc. The channel property data may further include information relating to the note pitch range (span) of available notes and information relating to the velocity (touch responsive intensity) range for the tone generation. The performance property data can be set independently on the tone generation channels, and may be of a so-called "layer structure" in which a performance on one song data track are assigned to a plurality of tone generation channels for the musical tone generation. For example in FIG. 2*b*, the song data track number (1) is assigned to two tone generation channels CH1 and CH2, and thereby the song events in the first song data track are handled by the first tone generation channel and the second tone generation channel. This realizes the musical tone generation for one song track from the two tone generation channels in two different tone color and plays back the song in a thick sensation.

FIG. 2*c* shows a conceptual chart of an example of an assignment table employed in an embodiment of the present invention. The assignment table shows the corresponding relation between the tone generation channels and the song data track, and stores for each of the tone generation channels a song data track number which is to be assigned to this tone generation channel and whose song data are played back through this tone generation channel. The assignment table is a table stored in the RAM 3 and contains the song data channel numbers for the respective tone generation channels which are extracted from the performance property data of FIG. 2*b*, and will be rewritten every time the performance property data are altered for a chained playback of the songs. While each of the tone generation channels are set to be used for playing back some song data track according to the assignment shown in FIG. 2*c*, some of the tone generation channels may be allotted to the tone generation for the musician's performance on the keyboard. In the latter case, a particular tone generation channel or channels may be nominated for the keyboard performance in the performance property data of FIG. 2*b*.

FIG. 2*d* shows a conceptual chart of an example of a song data set employed in an embodiment of the present invention. The song chain data is a data set which contains a list of the song ID numbers indicative of songs (music pieces) to be played back in a chain in the arrayed order there and contains a list of the performance property ID numbers indicative of performance properties to be employed for playing back the respective songs, the song ID numbers and the performance property ID numbers are arrayed in a corresponding positions. At the end of the table, there is an end data to show the end of the table. For playing back the songs in a chain, the song chain list data is stored in the RAM containing the song ID numbers and the performance property ID numbers in an amount of one sequence, the CPU 1 looks up the song ID number and the corresponding performance property ID number, one pair after another, sets the tone generation parameters in the tone generator 8 and the tone effect parameters in the effector 9, and plays back the song data through the tone generator 8 and the effector 9. The songs will be played back one after another successively referring to the song ID numbers and the performance property ID numbers until the end data is read out.

Now a description will be made about the operation of the song chain playback and the song chain list composition, making reference to flow charts of the processing. FIGS. 3*a* and 3*b*, in combination, show a flow chart of a main routine of the control program executed in an embodiment of the present invention, including the operation of playing back songs (music pieces) in a chain and the operation of composing a song (music piece) chain list. The main routine is to detect any commands from the user including manipulation of any controls (switches, keys, etc.) and to execute necessary processing accordingly. If there is no command from the user, the flow is simply kept looping without executing processes. FIGS. 4*a* and *b*, in combination, show a flow chart of an interrupt processing executed in an embodiment of the present invention. The interrupt routine is to execute the tone generation processing for playing back songs. If no playback is commanded, the flow simply bypasses the steps to execute no processes. In the description of the control operation of the CPU 1 according to the program, the following flags are used to indicate particular conditions in the operation as mentioned below.

RUN: a flag indicating whether to conduct playback of a song or a song chain,
wherein "1" means "to play back," and "0" means "not to play back,"

CHAIN: a flag indicating whether to read out a song chain data, wherein "1" means "to read out," and "0" means "not to read out."

In FIG. 3, a step S1 is to initialize the computer configured system, including to reset (to "0") the various flags and the contents of the assignment table, to set parameters for the initial tone color, and so forth. A step S2 is for the user to manually select a song (music piece) and for the system to prepare for reading out the song progression of the selected song data. The preparation includes various settings according to the initial setting information in the song data and placing the read-out pointer at the head of the song progression. At a step S3, the user selects an intended performance property data set manually and the system establishes various settings including parameters for the tone generator 8, parameters for the effector 9, switch conditions of various controls in the panel, alteration of the contents of the assignment table (FIG. 2*c*).

Next, a step S4 judges whether the song playback is commanded by the song playback switch, and if the judgment is negative (NO), the program skips to a step S6 (FIG. 3*b*), while if affirmative (YES), the program steps forward to a step S5. The step S5 sets "1" to the RUN flag and "0" to the CHAIN flag before proceeding to a step S6 (FIG. 3*b*). The step S6 judges whether the chain data composition switch commands to compose a song chain data, and if the judgment is negative (NO), the process jumps to a step S13 (FIG. 3*a*), while if affirmative (YES), the process moves forward to a step S7 to start composing a song chain data.

The step S7 is to designate a position to place (add, insert or substitute) a new song in the song chain, namely a new song ID number into the recorded song chain data storage area. The display screen 6 exhibits the storage areas by the numbers arrayed in an ascending order for constituent songs of a song chain. Where some songs have already been nominated to be members of a chain list, the respective song ID numbers of the nominated songs are exhibited in correspondence to the respective ascending storage area numbers, and the ascending area number next to the last one having a corresponding song ID number is highlighted by means of a blinking cursor or the like. This is the default cursor position. The user may move the cursor to any intended position in the exhibited number array. In any case, the cursor position will be the position to place a new song ID number and a new performance property ID number. The user can select whether to add a new number, or insert or substitute a new number in the following manner.

<Addition> With the cursor staying at the above default position, the user actuates the predetermined switch (i.e. enter button) intact, and then the system sets the write-in pointer of the storage area such that the new song ID number will be stored in the storage area next to the storage area of the last song ID number through the later steps. A new song ID number (data) and a new performance property ID number (data) will be added to the tail of the already established song chain list (data).

<Edition> With the cursor moved to an arbitrarily desired position among the ascending storage area numbers where the song ID numbers and the performance property ID numbers have already been stored thereby highlighting the intended edit position, the user actuates the predetermined switch (i.e. overwrite button or insert button), and then the system sets the write-in pointer of the storage area such that the new song ID number and the new performance property ID number will supersede the pointed former song ID number and performance property ID number or will be inserted at the pointed position, by pushing the pointed former song ID number and performance property ID number downward (in the ascending direction) by one line through the later steps. The new song number and the new property number may be recorded in the pointed area after the old stored numbers in the storage areas after the pointed area have been shifted toward the ascending direction by one pitch. Or the new song number and the new property number may be recorded in any open area with the pointer linkage adjustment to virtually realize such a data insertion amidst the data array.

After the step S7 above, a step S8 designates (by the ID numbers) a song data set and a performance property data set according to the user's selection by actuating the song selection switch and the performance property selection switch. Next, a step 9 monitors whether the above selected addition or substitution or insertion of the designated song data set and performance property data set is determined, i.e. should be executed. If no determination command is entered (or cancellation is commanded), the process loops back to the step S7 until some determination command is entered.

If some determination is entered and the step S9 judges affirmative (YES), the process moves forward to a step S10, and the step S10 records the new song ID number and performance property ID number into the heretofore existing song chain list data. Thus the process of addition or edition according to the designation at the step S7 is completed. Next, a step S11 judges whether the termination of the song chain data is commanded or not by means of a predetermined switch (e.g. stop button). If the termination is not commanded (or continuation is commanded), the process goes back to the step S7 to continue the song chain list data composition. If the termination is commanded, a step S12 records end data at the tail of the composed song chain list data, before going forward to a step S13 (FIG. 3*a*).

The step S13 judges whether the song chain playback is commanded by actuating the song chain playback switch. If the judgment is negative (NO), the process skips to a step S16, while if the judgment is affirmative (YES), a step S14 sets "1" to the RUN flag and the CHAIN flag to further go to a step S15. The step S15 sets the tone generator 8 and the effector 9 according to the first performance property data set as nominated by the song chain list and prepares to start reading out the first song data set as nominated by the song chain list. In the preparation for starting this read-out procedure, the read-out pointer is set at the top data among the song progression, i.e. the first time point data of the first song data set as nominated by the song chain data set, as the read-out starting position. In this instance, the initial setting information in the song data set is neglected, because such information is obtained from the performance property data set. Although not shown in the flow chart, if the song chain playback is commanded when the individual playback of a song data is running, the running song playback will be forcibly discontinued and the above processing for starting the song chain playback will supersede.

The step S16 conducts other processing such as processing according to the tone color setting switches, the effect setting switches, the tempo setting switch, processing in response to the manipulation of the keyboard, and so forth. A step S17 monitors whether there is issued a command to terminate the main routine processing, and if no such termination command is issued, the process goes back to the step S2 to repeat the processing flow, while if such a termination command is issued, the main routine processing will comes to an end.

As described above specifically and in detail, the present invention enables the composition (by addition, substitution, and insertion) of a song chain list data set by an easy operation at the user's side through the steps S7–S12 of FIG. 3*b*, and enables the chained playback of a plurality of songs according to the song chain data set by setting the CHAIN flag at the step S14, as will be described in more detail hereinbelow regarding the interrupt routine of FIGS. 4*a* and 4*b* for playing back songs, i.e. for generating musical tones.

The interrupt processing of FIGS. 4*a* and 4*b* is activated periodically by the interrupt signals from the timer 7, interrupting the main routine processing. There is provided a counter which counts the interrupt clock signals to make a time count reference pulse for the music progression. The count value of this counter is reset to the initial value when the song data of an amount of one song (music piece) runs out, to be a starting count for the next song data.

First, a step S21 judges whether RUN=1, and if not RUN=1, the process returns to the original processing routine, and if RUN=1, a step S22 judges whether it is time to execute a new event by comparing the time point data in the song data and the above-mentioned count value of the running counter. If the judgment is affirmative (YES), the process of a step S23 takes place, and if the judgment is negative (NO), the process returns to the original processing routine. The step S23 reads out new event data from the song data set.

A step S24 judges whether the read-out event data is end data. If the judgment is affirmative (YES), it means the end of a song which has been being played back, and the process goes to a step S27, while if the judgment is negative (NO), the process proceeds to a step S25. The step S25 judges whether CHAIN=1 and the read-out data is of an event of setting. If the judgment is affirmative (YES), the process goes back to the original routine, and if negative (NO), the process proceeds to a step S26. The step S26 is for processing various events, and now executes processing according to the present event data. Namely, if the event is a note-on event or a note-off event, the step S26 sends the data to the corresponding tone generation channel of the tone generator 8 and conducts a process for tone generation or tone extinction. If the event is a parameter setting event, the step S26 conducts a process for the designated setting with respect to the tone generator 8 (e.g. for tone color parameter setting) or the effector 9 (e.g. for tone effect setting).

In this embodiment, the processing of S26 is commonly applicable to the individual song playback and the chained song playback, and realize a song progression with musical tones. For the song playback where the flag CHAIN=0, the step S26 works for both the tone generation control and the parameter setting, and the tones will be played back according to the tone events (note-on's and note-off s) and according to the parameter setting events, if any, such as a change in tone color, a change in tempo, a change in tone effect, or else. For the song chain playback where the flag CHAIN=1, however, the step S26 works for the tone generation control only and not for the various parameter setting, because the judgment step S25 diverts the process flow away from the step S26. Consequently, under the song chain playback condition, the apparatus plays back musical tones disregarding the setting event data in the song data set and therefore according to the setting by the performance property data set as will be described later. This prevents inadvertent occurrences of discontinuity in a music performance (playing back songs) which may otherwise occur by the change in parameters from those set by the performance property data to those instantaneously set by the parameter setting events in the song data.

The step S27 judges whether CHAIN=0, and if the judgment is affirmative (YES), the process goes to a step S31, and if negative (NO), the process moves forward to a step S28 to read out new event data from the song data set. Next, a step S29 judges whether the read-out data is end data or not. If it is end data, the process is directed to the step S31, and if not, the process goes forward to a step 30. The step S30 alters the setting of parameters for the tone generator 8 and the effector 9 according to the newly designated performance property data sets in connection with the present song, and prepares to start reading out the song progression events in the newly designated song data, before returning to the original routine. This preparation is similar to that in the step S15, and disregards the initial setting information in the song data set and sets the read-out pointer at the top data in the song progression portion to be a position for starting the read-out operation.

The step S31 is conducted at the end of an individual song playback where CHAIN=0 and the read-out data from the song data set is the end data, and at the end of a chained song playback (end of a sequence) where CHAIN=1 and the read-out data from the song chain list data set is the end data. The step S31 sets "0" to the RUN flag and to the CHAIN flag, and extinguish all tones now being generated, if any, to terminate the individual song playback or the chained song play back, before returning to the original routine.

As will be understood from the above explanation, in the case of an individual song playback, one designated song (a designated music piece) is played back according to the selected song data set, whereas in the case of a chained song playback, a sequence of plural consecutive songs (music pieces) is played back according to the song data sets as designated by the song chain list data set. In the individual song playback, the musical tones will be played back according to the tone events and the various setting events in the song data set, but in the chained song playback, the musical tones will be played back according to the tone events in the song data set and to the setting information in the performance property data set disregarding the setting event data in the song data set, through the functions at the steps S25, S26 and S30. Thus, the songs will be played back in a chain according to the intended musical arrangement by the user.

Although a preferred embodiment has been described hereinabove, various modifications may be introduced within the spirit of the present invention.

For example, the song chain list may not necessarily be of the structure in which the performance property ID numbers correspond to the song ID numbers in one-to-one correspondence, but may be of the structure in which a plurality of performance property ID numbers are provided per song ID number, i.e. a sequence of performance property ID numbers correspond to one song ID number, containing data on switching time points and performance property ID numbers to be employed for one corresponding song ID number.

Where the song data read-out device (a sequencer) and the tone generator are connected according to the MIDI protocol, the song data track numbers (Tr1, Tr2, . . . ) of the event data in a song data set may be substituted by the MIDI channel numbers used in the MIDI data transmission. That is, a different MIDI transmission channel is assigned to each song data track. In such an instance, the song data track numbers (Tr numbers) which are allotted to the respective tone generation channels in the performance property data set may be replaced by the MIDI transmission channel numbers. This means the respective MIDI channels are handle like the song data channels.

While the above described embodiment utilizes performance property ID numbers to identify performance property data sets, music category names such as "jazz" and "pops" may be used to identify performance property data sets. In such a case, each performance property set had better includes performance properties which are adequate for each named music category. This fashion will be advantageous to the user in understanding the type of performance properties in selecting an intended one for the intended musical arrangement. With respect to the song data sets, such category (genre) names may be given to the respective song data sets for easy selection of the songs.

The apparatus may be so configured that at least one of the performance property data sets includes plural subsets of performance property data representing plural subsets of performance properties, and may further include a track selecting device for selecting, from among the plural song data tracks, particular tracks which are to employ subsets of performance properties represented by the plural subsets of performance property data included in at least one performance property data set, so that the user can compose a song chain list data incorporating the capability of selecting song data tracks to be applied with intended subsets of performance properties. In such a case, the song data set includes information as to which of the song data tracks will use the performance properties as represented by the performance property data and which of the song data tracks will not use the performance properties as represented by the performance property data. For the tracks which will not reflect the setting by the performance property data, the properties of the played-back tones will be determined by the property event data in the song progression of the song data. This facilitates delicate musical arrangements by the user in view of the tone properties of the played-back songs.

While the initial setting data and the setting event data included in the song data set are neglected at the time of song chain playback, those setting data may be utilized for altering the settings accordingly.

While the above description refers to the case in which one set of song chain list data is composed and stored in the RAM, there may be stored plural sets of song chain list data such that an arbitrary one can be selected by the user to play back.

While the above embodiment employs the timbre number as the data for setting the timbres in the performance property data set, timbre parameters may be employed instead.

The song chain data may include a song ID number which does not have a corresponding performance property ID number. Namely, there may be a song or songs which do not have an allotted set of performance properties. Such a song may be played back by using the performance properties which are set for the preceding song intact, or by setting the tone properties according to the setting event data or the initial setting data in the song data set.

The present invention is not necessarily be limited to a keyboard type electronic musical instrument as described in the above embodiment, but may be of a string instrument type, a wood-wind instrument type, a percussion instrument type, or else. The present invention is also applicable to an automatic playing piano.

Further, the apparatus may not necessarily be an integrated electronic musical instrument incorporating a tone generator and an automatic accompaniment function, but may be configured with a separate tone generator, sequencer, effector, etc. connected with each other by means of the MIDI cables or various communication networks.

While the above description is about the case of an electronic musical instrument, the same function may be realized by a personal computer and application software. The application software may preferable be stored in arbitrary storage media such as a magnetic disk, an optical disk and a semiconductor memory, and may be installed into the personal computer or may be supplied via a communication network to the personal computer.

The data format for the song progression in the above embodiment is of an "absolute time+event" type which represents the time of an event by an absolute time position from the top of the music piece or of each measure, but alternatively may be of a "relative time+event" type which represents the time of an event by a time lapse from the preceding event, or may be of a "note pitch (rest)+duration" type which represents the time of an event by the pitch and the duration of each note and by the rest (no pitch) and the duration of a rest, or may be of a "direct memory mapping" type in which memory regions are secured (allotted) for all the available time points under the minimum resolution of time for the music progression and each performance event is written at a memory region which is allotted to the time point of such event, or may be of other applicable types known in the art.

In the above description, the control programs are stored in the ROM 2, but such programs may be stored in any arbitrary external storage device 11 such as a hard disk, a floppy disk, a CD-ROM and an MO disk. For example, in the case of a CD-ROM, the control programs stored in the CD-ROM are transferred to the hard disk first, and then to the RAM 3 so that the CPU 1 accesses the RAM 3 in the same manner as the case of the ROM 2. This facilitates an installment of a new program or a partial addition of a program, and therefore an up-grading of the program. Further alternatively, the programs may be stored in a floppy disk, a magnetic disk, an MO disk, or else and may be transferred to the hard disk or the RAM 3. The control programs may be downloaded through the communication interface 12 of the electronic musical instrument of the embodiment from a remote server computer. In such a case, the apparatus is connected to a communication network 13 such as a LAN (local area network), Internet and a telephone line to receive control programs, song data and performance property data from a server computer via the communication network 13. Thus received programs and data are downloaded into the hard disk. In this case, the communication interface 12 may not be limited to a unique MIDI interface, but may be any type of general-purpose interface such as RS-232C, USB (universal serial bus), IEEE 1396 to constitute a MIDI interface.

While particular embodiments of the invention and particular modification have been described, it will, of course, be understood by those skilled in the art without departing from the spirit of the present invention so that the invention is not limited thereto, since further modifications may be made by those skilled in the art, particularly in light of the foregoing teachings. It is therefore contemplated by the appended claims to cover any such modifications that incorporate those features of these improvements in the true spirit and scope of the invention.

What is claimed is:

1. A music chain playing-back apparatus comprising:

a first data storage area which stores a plurality of music data sets, each having a music identification number and representing a music piece as a time progression of musical tones defined by pitches and times;

a second data storage area which stores a plurality of performance property data sets, each having a property identification number and representing a set of performance properties defining tone properties of said musical tones when performed;

a third data storage area which stores a chain list data set containing a list of said music identification numbers indicative of music data sets to be played back from among said plurality of music data sets in the order for playback and a list of said property identification numbers indicative of performance property data sets to be employed from among said plurality of performance property data sets in the order for employment;

a chain list reading module which reads out said music identification numbers in said order for playback and said property identification numbers in said order for employment;

a music data reading module which reads out said music data sets as identified by said read-out music identification numbers;

a property data reading module which reads out said performance property data sets as identified by said read-out property identification numbers; and a tone generating module which generates tones with tone pitches and at times defined by said read-out music data set and in tone properties defined by said read-out performance property data set.

2. A music chain playing-back apparatus as claimed in claim 1, wherein said tone properties defined by said set of performance properties include tone colors of the generated tones and tone effects imparted to the generated tones.

3. A music chain playing-back apparatus as claimed in claim 1, further comprising:

an individual music designating module which is selectively operative and is capable of designating individual music data set from among said plurality of music data sets; and wherein said music data set includes data regarding tone pitches and times for said musical tones in said music piece and further includes data regarding tone properties for said musical tones in said music piece; and when said individual music designating module is selected operative, said music data reading module reads out, according to said individual designation, said music data set including data regarding tone pitches, times and tone properties, and said tone generating module generates tones with tone pitches, at times and in tone properties as defined by said individually designated music data set; and when said individual music designating module is selected non-operative, said music data reading module reads out said music data set including data regarding tone pitches and times but disregarding tone properties, and said tone generating module generates tones with tone pitches and at times defined by said read-out music data set and in tone properties defined by said read-out performance property data set.

4. A music chain playing-back apparatus as claimed in claim 1, wherein at least one of said music data sets represents a music piece by plural tracks of time progression of musical tones, and at least one of said performance property data sets includes plural subsets of performance property data respectively representing plural subsets of performance properties respectively corresponding to said plural tracks of time progression of musical tones.

5. A music chain playing-back apparatus as claimed in claim 4, further comprising:

a track selecting module for selecting, from among said plural tracks, tracks which are to employ subsets of performance properties represented by said plural subsets of performance property data included in said at least one performance property data set, whereby said tone generating module generates tones for said selected tracks in said read-out music data in tone properties defined by said subsets of performance property data included in the read-out performance property data set.

6. A music chain data composing apparatus comprising:

a first data storage area which stores a plurality of music data sets, each having a music identification number and representing a music piece as a time progression of musical tones defined by pitches and times;

a second data storage area which stores a plurality of performance property data sets, each having a property identification number and representing a set of performance properties defining tone properties of said musical tones when performed;

a third data storage area for storing a chain list data set containing a list of said music identification numbers indicative of music data sets to be played back from among said plurality of music data sets in the order for playback and a list of said property identification numbers indicative of performance property data sets to be employed from among said plurality of performance property data sets in the order for employment;

a chain list nominating module which nominates said music identification numbers, one after another in a desired order for playback and said property identification numbers, one after another in a desired order for employment; and a chain list data storing module which stores said nominated music identification numbers and said nominated property identification numbers into said third data storage area, thereby composing a data set representing a list of chained music pieces.

7. A music chain data composing apparatus as claimed in claim 6, wherein said chain list data storing module stores said nominated music identification numbers and property identification numbers into said third data storage area with correspondence indication as to which property identification number corresponds to which music identification number.

8. A method for playing back a music chain comprising:

a step of storing in a storage device a plurality of music data sets, each having a music identification number and representing a music piece as a time progression of musical tones defined by pitches and times;

a step of storing in a storage device a plurality of performance property data sets, each having a property identification number and representing a set of performance properties defining tone properties of said musical tones when performed;

a step of storing in a storage device a chain list data set containing a list of said music identification numbers indicative of music data sets to be played back from among said plurality of music data sets in the order for playback and a list of said property identification numbers indicative of performance property data sets to be employed from among said plurality of performance property data sets in the order for employment;

a step of reading out said music identification numbers in said order for playback and said property identification numbers in said order for employment;

a step of reading out said music data sets as identified by said read-out music identification numbers;

a step of reading out said performance property data sets as identified by said read-out property identification numbers; and a step of generating tones with tone pitches and at times defined by said read-out music data set and in tone properties defined by said read-out performance property data set.

9. A method for composing music chain data comprising:

a step of storing in a storage device a plurality of music data sets, each having a music identification number and representing a music piece as a time progression of musical tones defined by pitches and times;

a step of storing in a storage device a plurality of performance property data sets, each having a property identification number and representing a set of performance properties defining tone properties of said musical tones when performed;

a step of nominating said music identification numbers indicative of music data sets to be played back from among said plurality of music data sets, one after another in a desired order for playback and said property identification numbers indicative of performance property data sets to be employed from among said plurality of performance property data sets, one after another in a desired order for employment;

a step of storing in a storage device said nominated music identification numbers and said nominated property identification numbers to constitute a list of said music identification numbers and a list of said property identification numbers, thereby composing a data set representing a list of chained music pieces.

10. A storage medium for use in an apparatus for playing back chained music pieces, said apparatus being of a data processing type comprising a computer and a storage device, said medium containing a program that is executable by the computer, the program comprising:

a module of storing in said storage device a plurality of music data sets, each having a music identification number and representing a music piece as a time progression of musical tones defined by pitches and times;

a module of storing in said storage device a plurality of performance property data sets, each having a property identification number and representing a set of performance properties defining tone properties of said musical tones when performed;

a module of storing in said storage device a chain list data set containing a list of said music identification numbers indicative of music data sets to be played back from among said plurality of music data sets in the order for playback and a list of said property identification numbers indicative of performance property data sets to be employed from among said plurality of performance property data sets in the order for employment;

a module of reading out said music identification numbers in said order for playback and said property identification numbers in said order for employment;

a module of reading out said music data sets as identified by said read-out music identification numbers;

a module of reading out said performance property data sets as identified by said read-out property identification numbers; and a module of generating tones with tone pitches and at times defined by said read-out music data set and in tone properties defined by said read-out performance property data set.

11. A storage medium for use in an apparatus for composing a data set representing a list of chained music pieces, said apparatus being of a data processing type comprising a computer and a storage device, said medium containing a program that is executable by the computer, the program comprising:

a module of storing in said storage device a plurality of music data sets, each having a music identification number and representing a music piece as a time progression of musical tones defined by pitches and times;

a module of storing in said storage device a plurality of performance property data sets, each having a property identification number and representing a set of performance properties defining tone properties of said musical tones when performed;

a module of nominating said music identification numbers indicative of music data sets to be played back from among said plurality of music data sets, one after another in a desired order for playback and said property identification numbers indicative of performance property data sets to be employed from among said plurality of performance property data sets, one after another in a desired order for employment; and a module of storing in said storage device said nominated music identification numbers and said nominated property identification numbers to constitute a list of said music identification numbers and a list of said property identification numbers, thereby composing a data set representing a list of chained music pieces.

* * * * *